US005380553A

United States Patent [19]

Loboda

[11] Patent Number: 5,380,553

[45] **Date of Patent: * Jan. 10, 1995**

[54] REVERSE DIRECTION PYROLYSIS PROCESSING

[75] Inventor: Mark J. Loboda, Midland, Mich.

[73] Assignee: Dow Corning Corporation, Midland, Mich.

[ * ] Notice: The portion of the term of this patent subsequent to Mar. 10, 2010 has been disclaimed.

[21] Appl. No.: 633,707

[22] Filed: Dec. 24, 1990

[51] Int. Cl.[6] ..... B05D 3/02

[52] U.S. Cl. ..... 427/226; 427/228; 427/376.2; 427/126.1; 427/126.2; 427/380

[58] Field of Search ..... 427/226, 228, 376.2, 427/126.1, 126.2, 380; 428/698

[56] References Cited

U.S. PATENT DOCUMENTS

| | | | |
|---|---|---|---|
| 3,615,272 | 10/1971 | Collins et al. | 23/366 |
| 4,749,631 | 6/1988 | Haluska et al. | 428/704 |
| 4,756,977 | 7/1988 | Haluska et al. | 428/704 |
| 4,822,697 | 4/1989 | Haluska et al. | 428/698 |
| 4,847,162 | 7/1989 | Haluska et al. | 428/457 |
| 4,911,992 | 3/1990 | Haluska et al. | 428/698 |
| 4,973,526 | 11/1990 | Haluska | 428/697 |

*Primary Examiner*—Shrive Beck
*Assistant Examiner*—Roy V. King
*Attorney, Agent, or Firm*—Roger E. Gobrogge

[57] ABSTRACT

The present invention relates to a method of forming a homogeneous ceramic coating on a substrate. The method comprises depositing a preceramic coating on a substrate and then heating the substrate while directing a stream of cooling gas at the surface of the preceramic coating such that a temperature gradient is developed in the coating. This temperature gradient is created in such a way that the preceramic material near the substrate is converted to its ceramic form while the preceramic material near the surface of the coating is deterred from conversion. The temperature gradient is then decreased over time such that all of the preceramic material ceramifies from the substrate outward to form a homogeneous coating on the substrate.

10 Claims, 8 Drawing Sheets

REVERSE DIRECTION PYROLYSIS PROCESSING

BACKGROUND

The present invention relates to a method of forming a homogeneous ceramic coating on a substrate. The method comprises depositing a preceramic coating on a substrate and then heating the substrate while directing a stream of cooling gas at the exterior surface of the preceramic coating such that a temperature gradient is developed in the coating. This temperature gradient allows the preceramic material near the substrate/coating interface to be converted to its ceramic form while deterring said conversion in the preceramic material near the exterior surface of the coating. The temperature gradient is then decreased over time such that all of the preceramic material ceramifies from the substrate outward to form a homogeneous coating on the substrate.

Numerous methods of depositing thin ceramic coatings on various substrates are known in the art. One such method involves dissolving a preceramic material in a solvent, applying the solution to a substrate, allowing the solvent to evaporate to deposit a preceramic coating on the substrate and then heating the coated substrate to a temperature sufficient to convert the preceramic coating to a ceramic coating. Such process are described, for example, in U.S. Pat. Nos. 4,749,631 and 4,756,977, both granted to Haluska et al. and assigned to Dow Corning Corporation, wherein the preceramic materials were silicate esters and hydrogen silsesquioxane resin, respectively.

Pyrolysis of preceramic materials in this type of process is generally performed by heating the coated substrate in a furnace under various gaseous environments to convert the material to a ceramic. When the coated substrate is processed in this manner, however, the coating begins to ceramify on the exterior surface resulting in the formation of a thin "skin" of dense ceramic material over the exterior surface of the coating. This skin prevents the escape of any volatile compounds which may be present or may be formed during pyrolysis and it inhibits diffusion of the gaseous environment into the coating. These trapped volatile compounds and the lack of gas diffusion, in turn, cause inhomogeneities in the resultant ceramic coating.

U.S. Pat. No. 5,059,448 describes a rapid thermal processing (RTP) technique for converting hydrogen silsesquioxane resin coatings to ceramic silica coatings. This technique decreases the thermal budget of a substrate by using high intensity radiation to rapidly heat (50°-300° C./sec) thin preceramic coatings to an elevated temperature for a time which allows the desired physical or chemical processes to be completed but not allow the substrate to be adversely affected. It is suggested therein that this technique may result in the coating ceramifying from the substrate outward.

The present inventor has now discovered that by using the method of this invention, ceramification of coatings can be controlled more effectively so that ceramification occurs sequentially from the substrate outward resulting in the formation of a high quality uniform coating.

SUMMARY OF THE INVENTION

The present invention relates to a method of forming a ceramic coating on a substrate. The method comprises applying a coating comprising a preceramic compound to a substrate. A temperature gradient is then created in the coating by heating the substrate to a temperature sufficient to facilitate ceramification of the interior surface of the coating while directing a stream of cooling gas at the exterior surface of the coating. The cooling gas is at a rate and temperature sufficient to deter ceramification of the exterior surface of the coating. The temperature gradient in the coating is then decreased sufficiently to facilitate ceramification of the exterior surface of the coating.

DETAILED DESCRIPTION OF THE INVENTION

Figure 1:
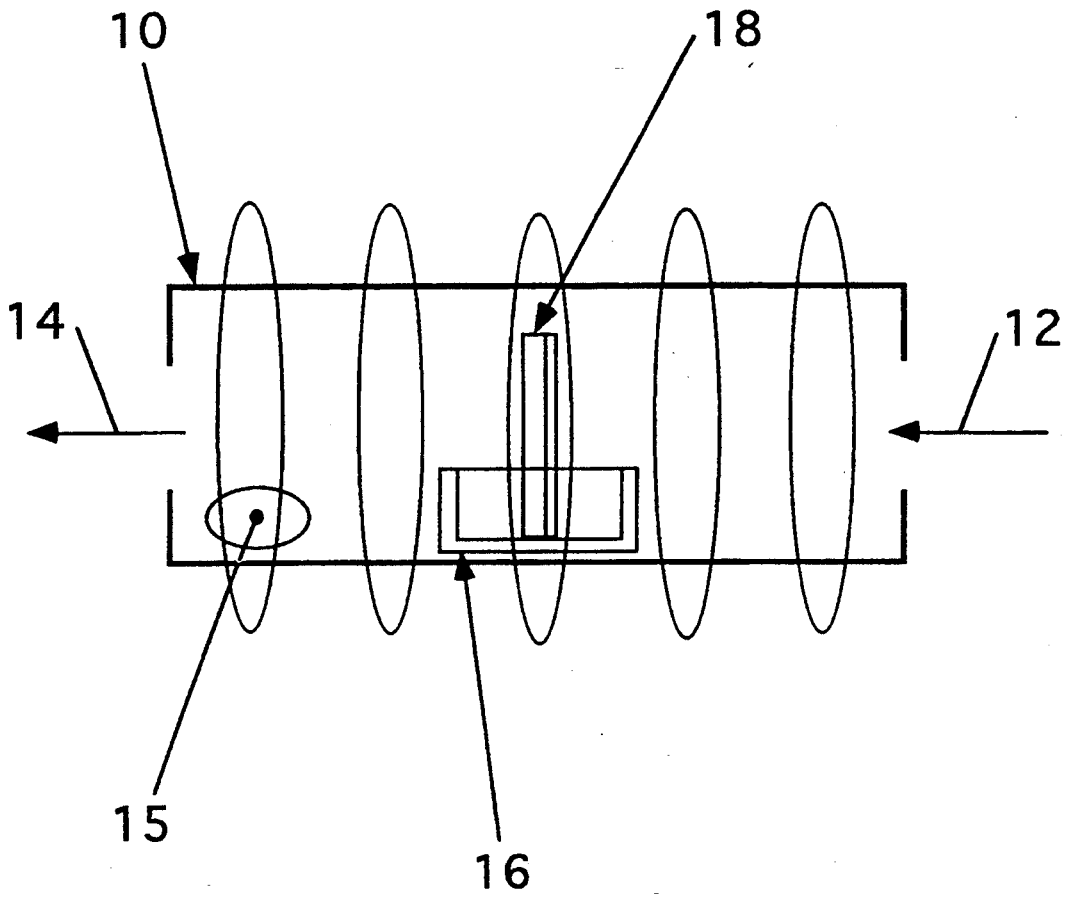

The present invention is based on the discovery that the pyrolysis of preceramic coatings by the methods described herein results in the formation of homogeneous ceramic coatings. This homogeneity has been shown to be the direct result of the preceramic coating ceramifying from the substrate outward.

Since the coatings derived by the process of this invention are of such high quality, they are advantageous as, for instance, protective or dielectric coatings on substrate articles such as electronic devices, electronic circuits or plastics including, for example, polyimides, epoxides, polytetrafluoroethylene and copolymers thereof, polycarbonates, acrylics and polyesters. However, the choice of substrates and devices to be coated by the instant invention is limited only by the need for thermal and chemical stability of the substrate at the temperature and atmosphere used in the present invention. The coatings taught herein also may serve as interlevel dielectric layers, doped dielectric layers to produce transistor like devices, pigment loaded binder systems containing silicon to produce capacitor and capacitor like devices, multilayer devices, 3-D devices, silicon on insulator devices, super lattice devices, protective layers for high temperature superconductors and the like.

In the present invention the 'exterior surface' of a coating is that surface where the coating contacts its gaseous environment and the 'interior surface' of a coating is that surface where the coating contacts the substrate; a 'preceramic compound' is any compound which can be converted to a ceramic by pyrolysis; a 'preceramic coating' is a coating of a preceramic compound on the substrate; and an 'electronic device' or 'electronic circuit' includes, but is not limited to, silicon based devices, gallium arsenide based devices, focal plane arrays, opto-electronic devices, photovoltaic cells and optical devices.

The novel coating process of the present invention comprises the following steps:

a coating comprising a preceramic compound is applied to the surface of a substrate; and the preceramic coating is converted to a ceramic coating by pyrolysis in the manner described herein.

The preceramic compound to be used in the process of this invention includes any material which can be converted to a ceramic with the application of heat. These compounds can be precursors to a variety of ceramic coatings including, for example, oxides such as $SiO_2$, $Al_2O_3$, $TiO_2$ or $ZrO_2$, nitrides such as silicon nitride, oxynitrides such as $SiO_xN_y$ or $AlO_xN_y$, oxycarbides such as SiOC, carbonitrides such as SiCN, sulfides such as $TiS_2$ or $GeS_2$, carbides such as SiC, or any combination of the above.

The preferred preceramic compounds to be used in the process of this invention are ceramic oxide precursors and, of these, precursors to $SiO_2$ or combinations of $SiO_2$ precursors with other oxide precursors are especially preferred. The silica precursors that are useful in the invention include hydrogen silsesquioxane resin (H-resin), hydrolyzed or partially hydrolyzed $R_xSi(OR)_{4-x}$, or combinations of the above, in which R is an aliphatic, alicyclic or aromatic substituent of 1–20 carbon atoms such as an alkyl (e.g. methyl, ethyl, propyl), alkenyl (e.g. vinyl or allyl), alkynyl (e.g. ethynyl), cyclopentyl, cyclohexyl, phenyl etc. and x is 0–2.

H-resin is used in this invention to describe a variety of hydridosilane resins which may be either fully condensed or those which may be only partially hydrolyzed and/or condensed. Exemplary of fully condensed H-resins are those formed by the process of Frye et al. in U.S. Pat. No. 3,615,272 which is incorporated herein by reference. This polymeric material has units of the formula $(HSiO_{3/2})_n$ in which n is generally 10–1000. The resin has a number average molecular weight of from about 800–2900 and a weight average molecular weight of between about 8000–28,000. When heated sufficiently, this material yields a ceramic coating essentially free of SiH bonds.

Exemplary H-resin which may not be fully condensed (polymers containing units of the formula $HSi(OH)_xO_{3-x/2}$) include those of Bank et al. in U.S. Pat. No. 5,010,159, or those of Frye et al. in U.S. Pat. No. 4,999,397, both of which are incorporated herein by reference. Bank et al. describes a process which comprises hydrolyzing hydridosilanes in an arylsulfonic acid hydrate hydrolysis medium to form a resin which is then contacted with a neutralizing agent. Recent experimentation has shown that an especially preferred H-resin which forms substantially crack-free coatings may be prepared by this method in which the acid/silane ratio is greater than about 2.67:1, preferably about 6/1. Frye et al. describe a process which comprises hydrolyzing trichlorosilane in a non-sulfur containing polar organic solvent by the addition of water or HCl and a metal oxide. The metal oxide therein acts as a HCl scavenger and, thereby, serves as a continuous source of water.

Exemplary of H-resin which is not fully hydrolyzed or condensed is that having units of the formula $HSi(OH)_x(OR)_yO_{z/2}$, in which each R is independently an organic group which, when bonded to silicon through the oxygen atom, forms a hydrolyzable substituent, x=0–2, y=0–2, z=1–3, x+y+z=3 and the average value of y over all of the units of the polymer is greater than 0. Examples of R groups in the above equation include alkyls of 1–6 carbon atoms such as methyl, ethyl, and propyl, aryls such as phenyl and alkenyls such as vinyl. Those resins may be formed by a process which comprises hydrolyzing a hydrocarbonoxy hydridosilane with water in an acidified oxygen-containing polar organic solvent.

The second type of silica precursor materials useful herein are hydrolyzed or partially hydrolyzed compounds of the formula $R_xSi(OR)_{4-X}$ in which R and x are as defined above. Specific compounds of this type include those in which the silicon atom is bonded to groups other than hydrolyzable substituents (i.e., x=1–2) such as methyltriethoxysilane, phenyltriethoxysilane, diethyldiethoxysilane, methyltrimethoxysilane, phenyltrimethoxysilane and vinyltrimethoxysilane. Compounds in which x=2 are generally not used alone as volatile cyclic structures are generated during pyrolysis, but minor amounts of said compounds may be cohydrolyzed with other silanes to prepare useful preceramic materials. Other compounds of this type include those in which the silicon is solely bound to hydrolyzable substituents (i.e., x=0) such as tetramethoxysilane, tetraethoxysilane, tetrapropoxysilane, and tetrabutoxysilane.

The addition of water to a solution of these compounds in an organic solvent results in hydrolysis or partial hydrolysis. Generally, a small amount of an acid or base is used to facilitate the hydrolysis reaction. The resultant hydrolyzates or partial hydrolyzates may comprise silicon atoms bonded to C, OH or OR groups, but a substantial portion of the material is believed to be condensed in the form of soluble Si—O—Si resins.

Additional silica precursor materials which may function equivalently in this invention include condensed esters of the formula $(RO)_3SiOSi(OR)_3$, disilanes of the formula $(RO)_xR_ySiSiR_y(OR)_x$, compounds containing structural units such as SiOC in which the carbon containing group is hydrolyzable under the thermal conditions, or any other source of SiOR.

In addition to the above $SiO_2$ precursors, other ceramic oxide precursors may also be advantageously used herein either as the sole coating compound or in combination with the above $SiO_2$ precursors. The ceramic oxide precursors specifically contemplated herein include compounds of various metals such as aluminum, titanium, zirconium, tantalum, niobium and/or vanadium as well as various non-metallic compounds such as those of boron or phosphorous which may be dissolved in solution, hydrolyzed, and subsequently pyrolyzed, at relatively low temperatures and relatively rapid reaction rates to form ceramic oxide coatings.

The above ceramic oxide precursor compounds generally have one or more hydrolyzable groups bonded to the above metal or non-metal, depending on the valence of the metal. The number of hydrolyzable groups to be included in these compounds is not critical as long as the compound is soluble in the solvent. Likewise, selection of the exact hydrolyzable substituent is not critical since the substituents are either hydrolyzed or pyrolyzed out of the system. Typical hydrolyzable groups include, but are not limited to, alkoxy, such as methoxy, propoxy, butoxy and hexoxy, acyloxy, such as acetoxy, or other organic groups bonded to said metal or non-metal through an oxygen such as acetylacetonate. Specific compounds, therefore, include zirconium tetracetylacetonate, titanium dibutoxy diacetylacetonate, aluminum triacetylacetonate and tetraisobutoxy titanium.

When $SiO_2$ is to be combined with one of the above ceramic oxide precursors, generally it is used in an amount such that the final ceramic coating contains 70 to 99.9 percent by weight $SiO_2$.

The preferred method for applying the coating comprising the above preceramic compound or compounds comprises coating the substrate with a solution comprising a solvent and the preceramic compound or compounds followed by evaporating the solvent. Such a solution is generally formed by simply dissolving the preceramic compound in a solvent or mixture of solvents. Various facilitating measures such as stirring and/or heat may be used to assist in this dissolution.

The solvents which may be used in this method include, for example, alcohols such as ethyl or isopropyl, aromatic hydrocarbons such as benzene or toluene, alkanes such as n-heptane or dodecane, ketones, cyclic dimethylpolysiloxanes, esters or glycol ethers, in an amount sufficient to dissolve the above materials to low solids. For instance, enough of the above solvent can be included to form a 0.1–85 weight percent solution.

If hydrogen silsesquioxane resin is used, a platinum or rhodium catalysts may also be included in the above coating solution to increase the rate and extent of its conversion to silica. Any platinum or rhodium compound or complex that can be solubilized in this solution will be operable. For instance, an organoplatinum composition such as platinum acetylacetonate or rhodium catalyst $RhCl_3[S(CH_2CH_2CH_2CH_3)_2]_3$, obtained from Dow Corning Corporation, Midland, Mich. are all within the scope of this invention. The above catalysts are generally added to the solution in an amount of between about 5 and 500 ppm platinum or rhodium based on the weight of resin.

The solution containing the preceramic compound(s), solvent and, optionally, a platinum or rhodium catalyst is then coated onto the substrate. The method of coating can be, but is not limited to, spin coating, dip coating, spray coating or flow coating.

The solvent is allowed to evaporate resulting in the deposition of a preceramic coating. Any suitable means of evaporation may be used such as simple air drying by exposure to an ambient environment or by the application of a vacuum or mild heat. It is to be noted that when spin coating is used, an additional drying period is generally not necessary as the spinning drives off the solvent.

It is to be noted that the above described methods of applying the preceramic coating primarily focus on a solution method. Other equivalent means of applying such coatings, however, would also function herein and are contemplated to be within the scope of this invention.

The preceramic coating applied by the above methods is then converted to a ceramic coating by heating it to a temperature sufficient for ceramification. The heat treatment herein is performed by heating the substrate while a stream of cooling gas, which is at a flow rate and temperature which deters conversion of the exterior surface of the preceramic coating to a ceramic coating, is directed at the exterior surface of the preceramic coating to establish a temperature gradient in the coating. The temperature gradient in the coating is then decreased sufficiently to facilitate ceramification of the exterior surface of the coating.

The substrate herein is preferably heated by placing its back side on a heat source in a manner which insures that a majority of the heat transfer occurs between the heat source and the substrate, and not to the processing environment. This generally occurs when the distance between the heat source and the coating is maximized while the distance between the heat source and substrate is minimized. As used herein, the "back side" of a substrate is that side which does not have the preceramic coating applied to it. Thus, for instance, the top side of an electronic circuit may be coated in the manner described herein and then the heat source applied to the bottom side thereof. Alternatively, however, the substrate may be heated by other convenient means, such as that described in the Example included herein, provided it allows the coating to ceramify from the substrate outward.

The heat source to be used herein can be any conventional heater which will heat the substrate to the desired temperature. Generally, the heater should have a larger thermal mass than the substrate such that the substrate is efficiently and uniformly heated. Examples of such devices include conventional hot plates, cartridge heaters, graphite heaters, optical heat sources and the like.

Generally, the substrates are heated to a temperature in the range of about 50° to about 1000° C., depending on the pyrolysis atmosphere, and for a time sufficient for conversion of the preceramic compound to its ceramic form. This heating may be accomplished by placing the substrate on a heat source which is already warmed or the heat source may be warmed after the substrate is placed on it. Moreover, heating may be conducted at a constant temperature, the temperature may be gradually increased or the temperature may be changed in a step-wise fashion. Higher temperatures usually result in quicker and more complete ceramification, but said temperatures also may have detrimental effects on various temperature sensitive substrates.

With the application of heat to the back side of the substrate, a stream of processing gas is directed at the exterior surface of the preceramic coating. The gas used herein should initially be at a temperature which is lower than the temperature of the heated substrate. In addition, it should initially flow at a rate which maintains the temperature of the exterior surface of the coating below that necessary for ceramification for as long as is necessary to achieve the beneficial results of this invention. Such a gas is described herein as a "cooling gas" . In this manner, a temperature gradient is created within the film in the direction normal to the film/substrate plane such that conversion of the coating to its ceramic state is more efficient at the substrate/coating interface than at its exterior surface. These conditions enhance (1) the release of volatiles that are formed during pyrolysis of the coating and (2) the diffusion of processing gases into the film where it can affect ceramification.

The temperature gradient in the coating is then decreased sufficiently to facilitate ceramification of the exterior surface of the coating. This can be achieved, for example, by adjusting the gas temperature and/or flow rate or by adjusting the heat source over time. It should be noted that under many of the above described pyrolysis conditions, merely maintaining the heat source and the gas temperature and flow rate for a sufficient period of time will result in ceramification of the exterior surface of the coating (because the conductive heat from the heated substrate eventually heats the exterior surface of the coating above the ceramification temperature even with the cooling gas directed at it). By this process, the coating is ceramified from the interior outward.

The cooling gases which may be used herein can be any which are conventionally used in ceramification such those which react with the coating to aid in ceramification or those which dope the coating. For instance, gases such as air, $O_2$, an inert gas ($N_2$, etc. as disclosed in the common assigned U.S. patent application Ser. No. 07/423,317 filed Oct. 18, 1989, now abandoned which is incorporated herein by reference), ammonia (as disclosed in U.S. Pat. No. 4,747,162 or U.S. patent application. Ser. No. 07/532,828 filed Jun. 4, 1990 which are both incorporated herein by reference), or amines (as disclosed in U.S. patent application Ser. No. 07/532,705 filed Jun. 4, 1990 which is incorporated herein by reference), are all functional herein. In addition, doping gases such as $PH_3$ to incorporate P, $B_2H_6$ to incorporate B, and $NH_3$ to incorporate N, are contemplated herein. Finally, it is contemplated that mixtures of the above gases may also be used.

The temperature and flow rate of the gas or gases utilized should initially be such that a temperature gradient as described above is formed within the coating. Therefore, the gas temperature should be lower than that desired for ceramification and, depending on the gas temperature chosen and the size of the coating, the flow rate can be adjusted to control the temperature gradient. The processing gas herein may be used at any temperature above its liquification point.

The time necessary to convert the preceramic coating to the ceramic coating will be variable depending on factors such as the preceramic compound, the temperature, the temperature gradient, the heat source, the gas, the rate of temperature gradient change, the coating thickness etc. Times in the range of minutes to hours, therefore, are contemplated herein. For the silica precursors described above, times in the range of about 1 minute to about 8 hours are contemplated.

By the above methods a thin, homogenous, ceramic coating is produced on the substrate. These coatings are useful on various substrates as protective coatings, as corrosion resistant and abrasion resistant coatings, as temperature and moisture resistant coatings, as dielectric layers in, for instance, multilayer electronic devices and as a diffusion barrier against ionic impurities such as sodium and chloride.

In addition, the coatings herein may be covered by other coatings such as further $SiO_2$ coatings, $SiO_2$/-ceramic oxide layers, silicon containing coatings, silicon carbon containing coatings, silicon nitrogen containing coatings, silicon oxygen nitrogen coatings, silicon nitrogen carbon containing coatings and/or diamond like carbon coatings.

In a dual layer system, the second passivation layer may comprise silicon containing coatings, silicon carbon-containing coatings, silicon oxynitride coatings, silicon nitrogen-containing coatings, silicon carbon nitrogen containing coatings, an additional silicon dioxide coating (which may contain a modifying ceramic oxide) or a diamond-like carbon coating. In a triple layer system, the second passivation layer may comprise silicon carbon-containing coatings, silicon oxynitride coatings, silicon nitrogen-containing coatings, silicon carbon nitrogen containing coatings, an additional silicon dioxide coating (which may contain a modifying ceramic oxide), or a diamond-like carbon coating and the third barrier coating may comprise silicon coatings, silicon carbon-containing coatings, silicon oxynitride coatings, silicon nitrogen-containing coatings, silicon carbon nitrogen containing coatings, or a diamond-like carbon coating.

The silicon containing coating described above is applied by a method selected from the group consisting of (a) chemical vapor deposition of a silane, halosilane, halodisilane, halopolysilane or mixtures thereof, (b) plasma enhanced chemical vapor deposition of a silane, halosilane, halodisilane, halopolysilane or mixtures thereof, or (c) metal assisted chemical vapor deposition of a silane, halosilane, halodisilane, halopolysilane or mixtures thereof. The silicon carbon coating is applied by a means selected from the group consisting of (1) chemical vapor deposition of a silane, alkylsilane, halosilane, halodisilane, halopolysilane or mixtures thereof in the presence of an alkane of one to six carbon atoms or an alkylsilane, (2) plasma enhanced chemical vapor deposition of a silane, alkylsilane, halosilane, halodisilane, halopolysilane or mixtures thereof in the presence of an alkane of one to six carbon atoms or an alkylsilane or (3) plasma enhanced chemical vapor deposition of a silacyclobutane or disilacyclobutane as further described in U.S. Pat. 5,011,706, which is incorporated herein in its entirety. The silicon nitrogen-containing coating is deposited by a means selected from the group consisting of (A) chemical vapor deposition of a silane, halosilane, halodisilane, halopolysilane or mixtures thereof in the presence of ammonia, (B) plasma enhanced chemical vapor deposition of a silane, halosilane, halodisilane, halopolysilane, or mixtures thereof in the presence of ammonia, (C) plasma enhanced chemical vapor deposition of a $SiH_4$—$N_2$ mixture such as that described by Ionic Systems or that of Katoh et al. in the Japanese Journal of Applied Physics, vol. 22, #5, pp 1321–1323, (D) reactive sputtering such as that described in Semiconductor International, p 34, August 1987 or (E) ceramification of a silicon and nitrogen containing preceramic copolymer. The silicon oxygen nitrogen containing coatings can be deposited by methods well known in the art such as the chemical vapor deposition, plasma enhanced chemical vapor deposition or low pressure chemical vapor deposition of a silicon compound (e.g., silane, dichlorosilane, etc.) with a nitrogen source (e.g., ammonia) and an oxygen source (e.g., oxygen, nitrogen oxides, etc.) by the pyrolysis of a silicon oxynitride precursor, or by the pyrolysis of a silicon compound in an environment which results in the formation of a silicon oxynitride coating. The silicon carbon nitrogen-containing coating is deposited by a means selected from the group consisting of (i) chemical vapor deposition of hexamethyldisilazane, (ii) plasma enhanced chemical vapor deposition of hexamethyldisilazane, (iii) chemical vapor deposition of silane, alkylsilane, halosilane, halodisilane, halopolysilane or mixture thereof in the presence of an alkane of one to six carbon atoms or an alkylsilane and further in the presence of ammonia, (iv) plasma enhanced chemical vapor deposition of a silane, alkylsilane, halosilane, halodisilane, halopolysilane or mixture thereof in the presence of an alkane of one to six carbon atoms or an alkylsilane and further in the presence of ammonia and (v) ceramification of a preceramic polymer solution comprising a carbon substituted polysilazane, polysilacyclobutasilazane or polycarbosilane in the presence of ammonia. The diamond-like carbon coatings can be applied by exposing the substrate to an argon beam containing a hydrocarbon in the manner described in NASA Tech Briefs, November 1989 or by one of the methods described by Spear in J. Am. Ceram. Soc., 72, 171–191 (1989). The silicon dioxide coating (which may contain a modifying ceramic oxide) is applied by the ceramification of a preceramic mixture comprising a silicon dioxide precursor (and a modifying ceramic oxide precursor) as in the initial coating.

The following non-limiting example is included so that one skilled in the art may more readily understand the invention.

EXAMPLE 1

Hydrogen silsesquioxane resin made by the method of Bank et al. in U.S. Pat. No. 5,010,159 was diluted to 10% in a cyclic polydimethylsiloxane solvent. A platinum catalyst comprising platinum acetylacetonate in toluene was added to the solution at a concentration of approximately 100 ppm platinum based on the weight of H-resin.

Enough of the above H-resin solution was applied to coat the entire surface of 6 clean 1 inch diameter silicon wafers and the wafers were spun at 3000 rpm for 30 seconds.

Figure 3:
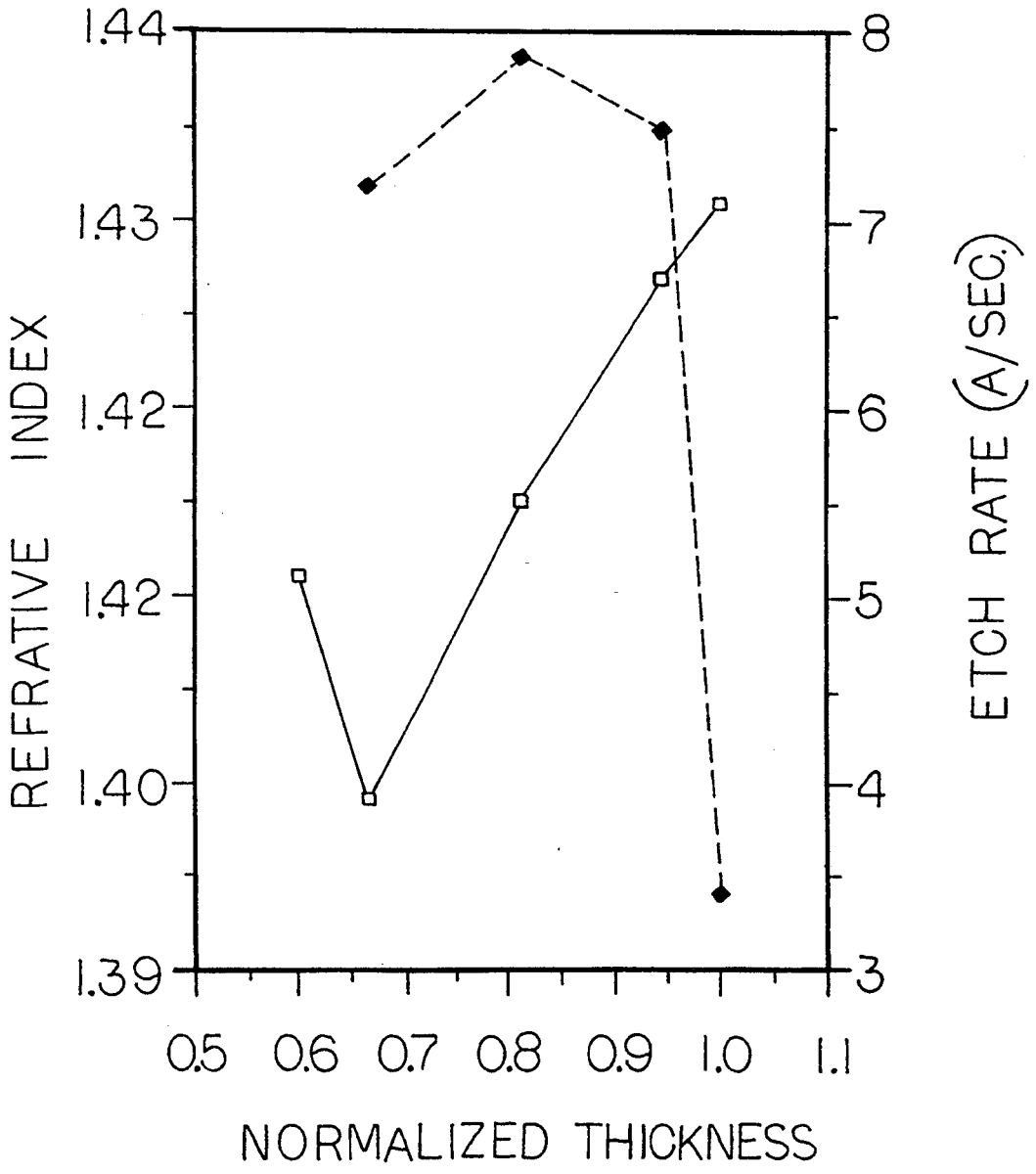
Figure 4:
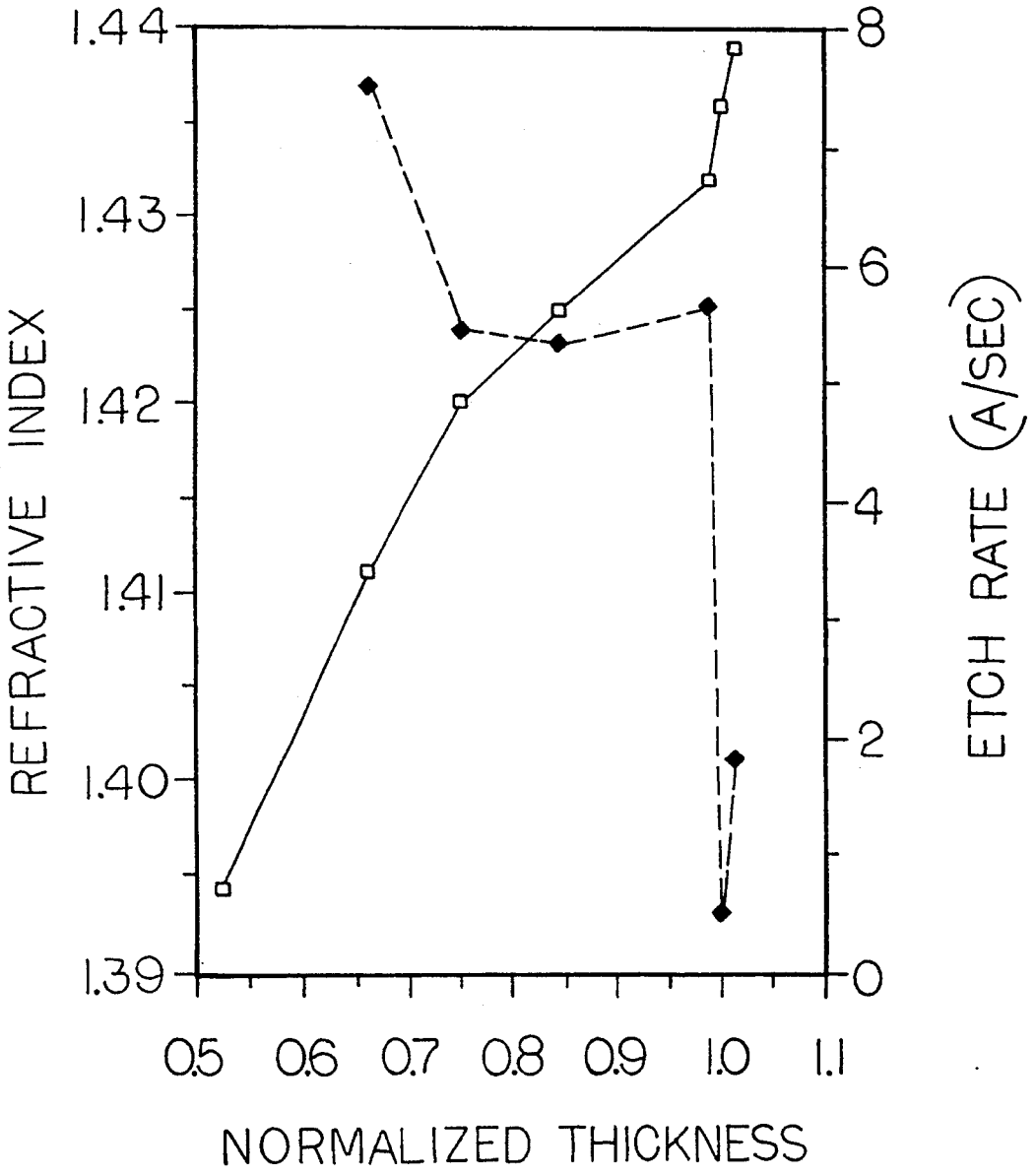
Figure 5:
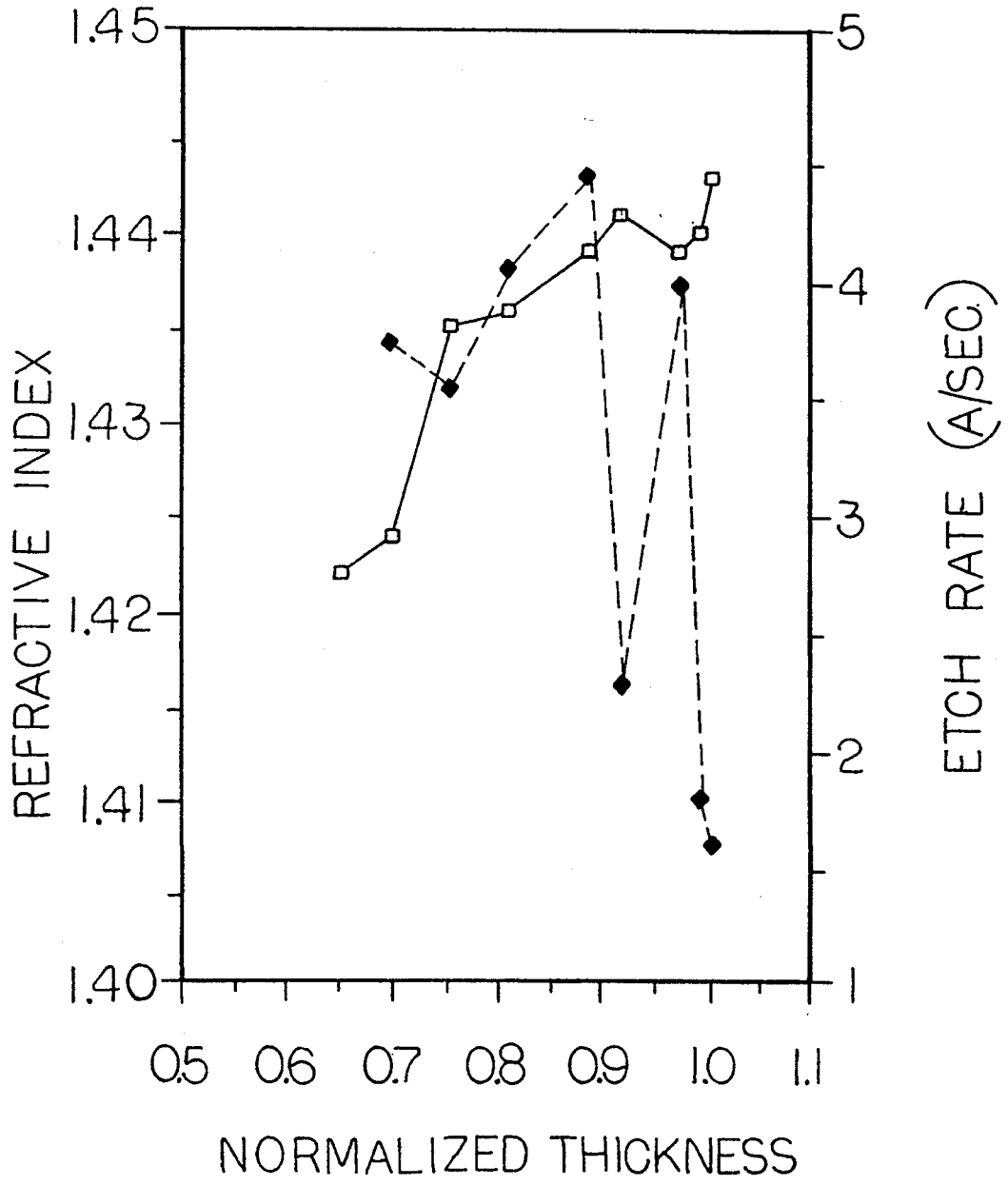
Figure 6:
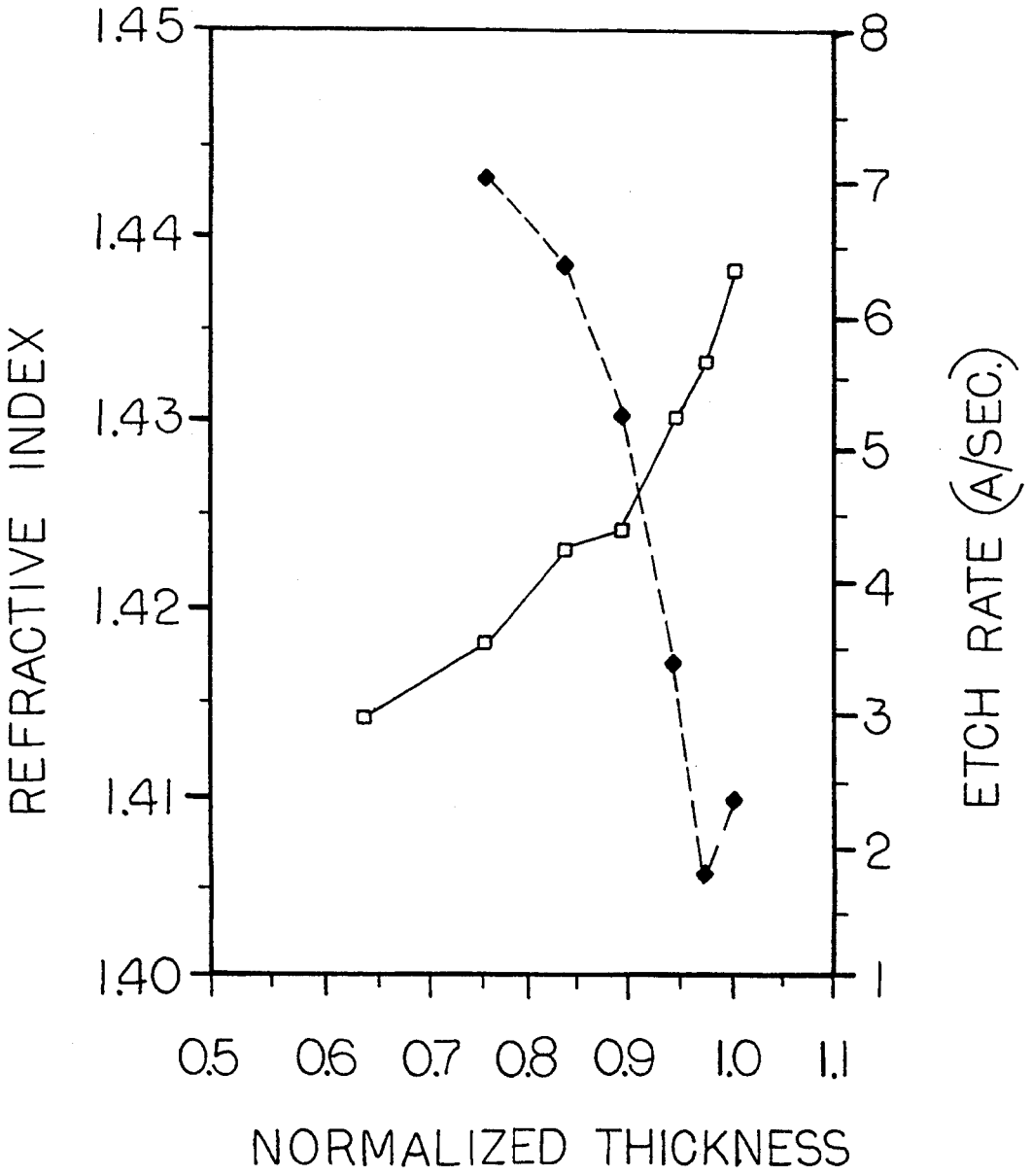

4 of the wafers (the wafers of FIGS. 3–6) were pyrolyzed in a standard tube furnace under the following conditions the wafer of FIG. 3 had a 1100 angstrom thick coating and was heated at 425° C. in oxygen; the wafer of FIG. 4 had a 1160 angstrom thick coating and was heated at 460° C. in oxygen; the wafer of FIG. 5 had a 1500 angstrom thick coating and was heated at 435° C. in ammonia; and the wafer of FIG. 6 had a 1500 angstrom thick coating and was heated at 200° C. in ammonia. A gas flow was directed at the film surface as depicted in FIG. 1. In this Figure, 10 is the quartz tube, 12 is the gas input; 14 is the gas output; 15 is a thermocouple mounted on the wafer; 16 is a quartz wafer boat; and 18 is a coated wafer.

Figure 2:
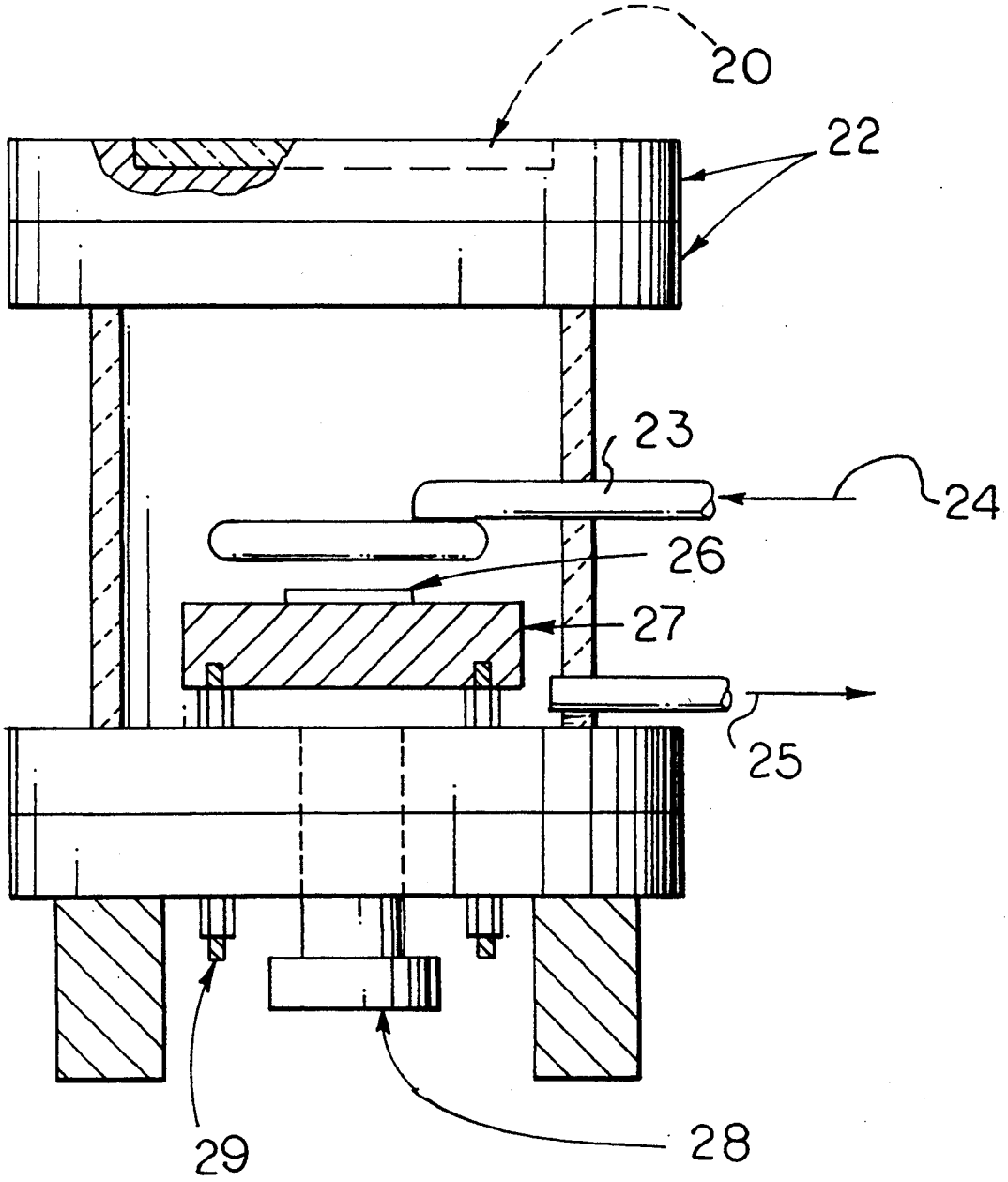
Figure 7:
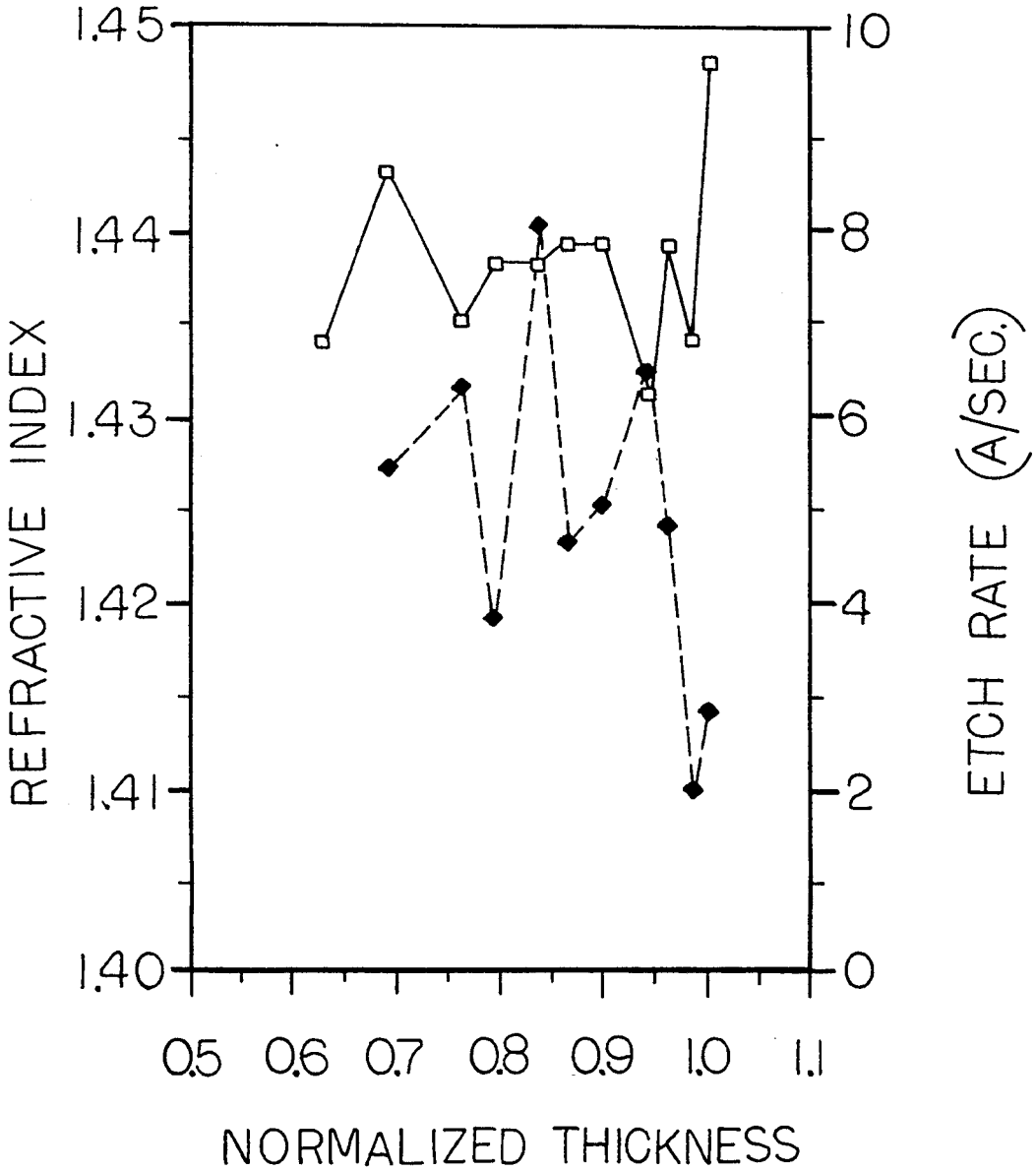
Figure 8:
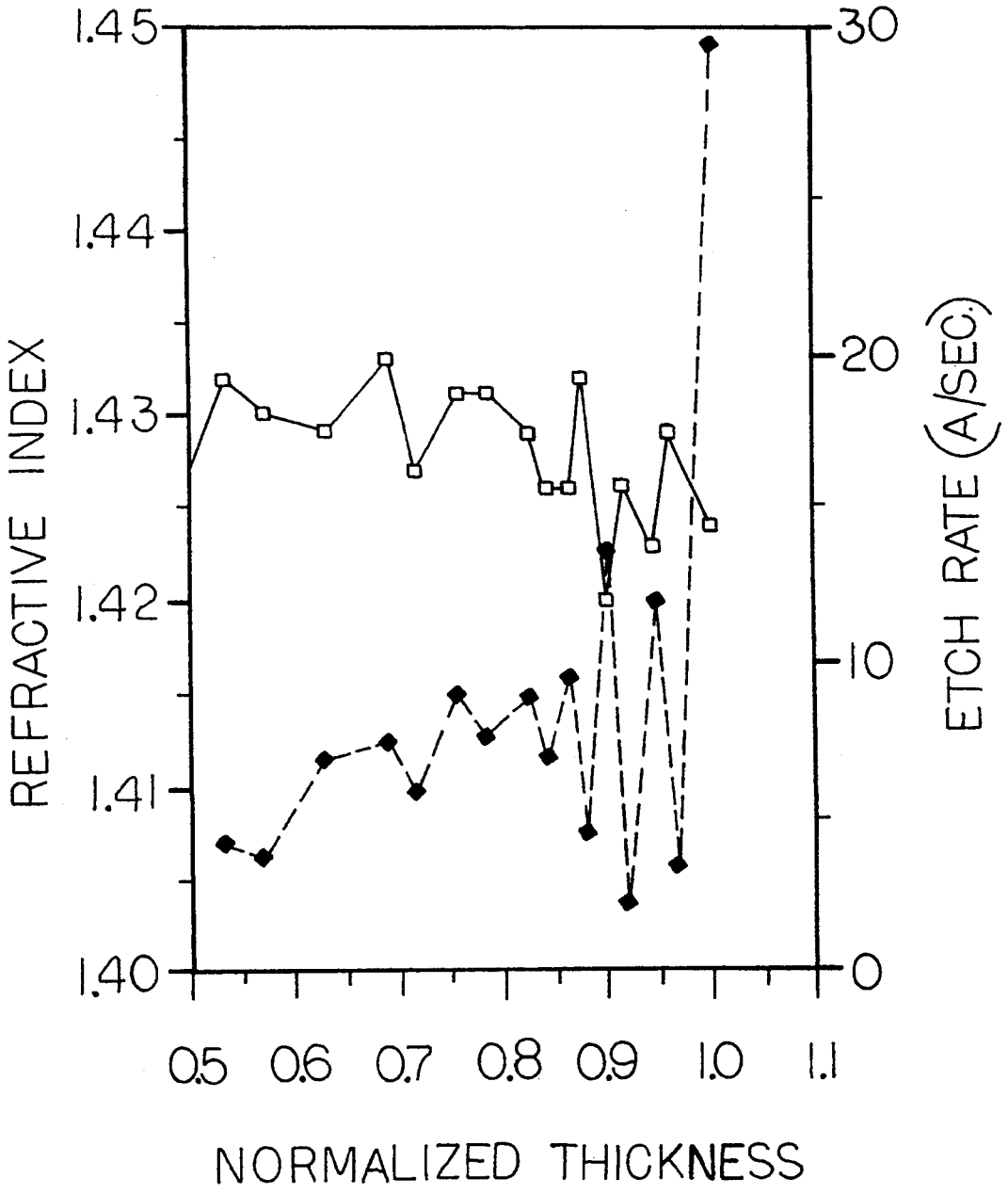

2 coated wafers (the wafers of FIGS. 7 and 8 wherein the coating FIG. 7 was 822 angstroms thick and the coating in FIG. 8 was 2180 angstroms thick) were placed in a closed reverse direction processing chamber as shown in FIG. 2. In this figure, 20 is a window; 22 are UHV flanges; 23 is a gas ring wherein process gases are input; 24 is a ¼ inch stainless steel pipe circle with a closed end; 26 is the coated sample; 27 is a copper heater block; 25 is the gas output; 28 are weld flanges for electric feedthru ports and temperature control; and 29 is a 10/32 threaded rod with locking nuts. Processing gases comprising ammonia and oxygen at room temperature were directed at the surface of the coating at 10 psi through a ¼ inch ID gas ring. The temperature of the heat block was raised to a maximum of 340° C. and maintained for approximately 1 hour. The flow of gas was then decreased to zero during cooling.

FTIR spectra run on all six of the coatings showed complete conversion to $SiO_2$. It should be noted that the spectra showed small variations of silanol content (SiOH) in the films but such variations only result in changes in the relative etch rates from sample to sample.

The uniformity of the above coatings was then measured by etch rates and refractive indices throughout the film thickness. The following graphs display these results (etch rates displayed as dashed lines with solid points and refractive indices displayed as solid lines with open points). For comparison, the thickness coordinate has been normalized so that 1.0 represents the top of the coating and 0.5 represents the middle of the coating. Additionally, note that the scale on the Y-axis for etch rate varies on some of the graphs.

It is clear form these graphs that the controls (the wafers of FIGS. 3–6) have a relatively slow etch rate at the surface of the coating and that the etch rate increases non-linearly towards the coating/wafer interface. This non-uniformity is likely the result of the 'skin' formation as described supra. On the contrary, it can be seen that the 2 samples pyrolyzed by the methods of this invention (the wafers of FIGS. 7 and 8) do not show the same effects. Rather, the etch rate and refractive index oscillate about an average value which is relatively constant throughout the film thickness.

That which is claimed is:

1. A method of forming a ceramic coating on a substrate comprising:

applying a coating comprising a preceramic compound on a substrate;

creating a temperature gradient in the coating sufficient to enhance the release of volatiles that are formed during pyrolysis of the coating to enhance the diffusion of processing gases into the coating by heating the substrate to a temperature sufficient to facilitate ceramification of the interior surface of the coating while directing a stream of cooling gas at the exterior surface of the coating, said cooling gas having a flow rate and temperature sufficient to deter ceramification of the exterior surface of the coating; and after the interior surface of the coating has reached the desired ceramification temperature, decreasing the temperature gradient in the coating sufficiently to facilitate ceramification of the exterior surface of the coating by a means selected from the group consisting of adjusting the gas temperature and/or flow rate, adjusting the heat source over time and maintaining the heat source and the gas temperature and flow rate for a time sufficient to allow ceramification of the exterior surface of the coating.

2. The method of claim 1 wherein the coating is applied by a process comprising coating the substrate with a solution comprising a solvent and the preceramic compound and then evaporating the solvent.

3. The method of claim 2 wherein the preceramic compound is selected from the group consisting of ceramic oxide precursors, ceramic nitride precursors, ceramic oxynitride precursors, ceramic sulfide precursors, ceramic carbide precursors, ceramic carbonitride precursors and ceramic oxycarbide precursors.

4. The method of claim 2 wherein the preceramic compound is a silica precursor selected from the group consisting of hydrogen silsesquioxane resin and hydrolyzed or partially hydrolyzed $R_xSi(OR)_{4-x}$, in which R is an aliphatic, alicyclic or aromatic substituent of 1–20 carbon atoms.

5. The method of claim 2 wherein the cooling gas is selected from the group consisting of air, $O_2$, an inert gas, ammonia, amines and a doping gas.

6. The method of claim 2 wherein the temperature gradient is created by heating the substrate to a temperature in the range of 50° to 1000° C.

7. The method of claim 3 wherein the solvent is selected from the group consisting of alcohols, aromatic hydrocarbons, alkanes, ketones, esters or glycol ethers and is present in an amount sufficient to dissolve the preceramic compound to between about 0.1 and about 50 weight percent.

8. The method of claim 4 wherein the substrate is heated to a temperature in the range of 50° to 1000° C. for a time in the range of about 1 minute to about 8 hours.

9. The method of claim 4 wherein the solution also contains a ceramic oxide precursor comprising a compound containing an element selected from the group consisting of titanium, zirconium, aluminum, tantalum, vanadium, niobium, boron and phosphorous wherein the compound contains at least one hydrolyzable substituent selected from the group consisting of alkoxy or acyloxy and the compound is present in an amount such that the ceramic coating contains 0.1 to 30 percent by weight modifying ceramic oxide.

10. The method of claim 4 wherein the solution also contains a platinum or rhodium catalyst in an amount of about 5 to about 500 ppm platinum based on the weight of resin.

* * * * *